US007117919B2

(12) United States Patent
Judkins

(10) Patent No.: US 7,117,919 B2
(45) Date of Patent: Oct. 10, 2006

(54) CORDLESS BLIND WITH LOCK MECHANISM

(76) Inventor: Ren Judkins, 46 Newgate Rd., Pittsburgh, PA (US) 15202

( * ) Notice: Subject to any disclaimer, the term of this patent is extended or adjusted under 35 U.S.C. 154(b) by 0 days.

(21) Appl. No.: 10/704,851

(22) Filed: Nov. 10, 2003

(65) Prior Publication Data

US 2004/0094274 A1 May 20, 2004

Related U.S. Application Data

(63) Continuation-in-part of application No. 09/815,403, filed on Mar. 22, 2001, now Pat. No. 6,644,372.

(51) Int. Cl.
*E06B 9/322* (2006.01)

(52) U.S. Cl. ..... 160/170; 160/173 R

(58) Field of Classification Search ..... 160/170, 160/171, 173 R, 178.2 R, 303, 304.1, 302; 242/384.7; 185/37; 114/199; 254/391
See application file for complete search history.

(56) References Cited

U.S. PATENT DOCUMENTS

| | | | | |
|---|---|---|---|---|
| 13,251 | A | 7/1855 | Bixler | |
| 322,732 | A | 7/1885 | Lang | |
| 1,951,659 | A | 3/1934 | Kesner | |
| 2,249,114 | A * | 7/1941 | Coffman | 242/384.7 |
| 2,317,659 | A | 4/1943 | Williams | |
| 2,420,301 | A | 5/1947 | Cusumano | |
| 2,659,573 | A * | 11/1953 | Smith, Sr. | 242/379.1 |
| 3,249,148 | A | 5/1966 | Zablodil et al. | |
| 3,485,285 | A * | 12/1969 | Anderle | 160/168.1 R |
| 3,487,875 | A | 1/1970 | Shukat et al. | |
| 4,623,012 | A | 11/1986 | Rude et al. | |
| 4,676,292 | A | 6/1987 | Valle et al. | |
| 4,909,298 | A * | 3/1990 | Langhart et al. | 160/178.1 R |
| 5,105,867 | A | 4/1992 | Coslett | |
| 5,133,399 | A | 7/1992 | Hiller et al. | |
| 5,263,786 | A | 11/1993 | Kageyama | |
| 5,285,838 | A | 2/1994 | Rapp et al. | |
| 5,476,132 | A | 12/1995 | Jacobson | |
| 5,482,100 | A | 1/1996 | Kuhar | |
| 5,531,257 | A | 7/1996 | Kuhar | |
| 5,680,891 | A | 10/1997 | Prince | |
| 5,706,876 | A | 1/1998 | Lysyj | |
| 5,778,956 | A | 7/1998 | Judkins | |
| 5,813,447 | A | 9/1998 | Lysyj | |
| 5,906,232 | A * | 5/1999 | Bauer et al. | 160/170 |
| 5,915,866 | A | 6/1999 | Furukawa | |
| 5,960,846 | A | 10/1999 | Lysyj | |
| 5,997,204 | A | 12/1999 | Ducrocq | |
| 6,003,584 | A | 12/1999 | Weinreich | |

(Continued)

*Primary Examiner*—Blair M. Johnson
(74) *Attorney, Agent, or Firm*—Buchanan Ingersoll & Rooney PC

(57) ABSTRACT

A cordless blind contains one or more spring motors, one or more cord collectors and a lock mechanism. The lock mechanism has a button or lever or two buttons or levers which when pressed and released will change the lock from a locked position, wherein the lift cords are restrained from being collected on or released from the cord collector, and has an unlocked position that allows the lift cords and cord collector to freely move when pressed again the button or lever will change the lock mechanism from the unlocked position to the locked position. A cord or wand may be connected to the button or lever. Then the operator can place the bottomrail or moving rail of the blind at any desired location between a fully raised position and a fully lowered position.

20 Claims, 10 Drawing Sheets

U.S. PATENT DOCUMENTS

| | | | | |
|---|---|---|---|---|
| 6,012,506 | A | 1/2000 | Wang et al. | |
| 6,024,154 | A | 2/2000 | Wang et al. | |
| 6,029,734 | A | 2/2000 | Wang et al. | |
| 6,056,036 | A | 5/2000 | Todd et al. | |
| 6,079,471 | A | 6/2000 | Kuhar | |
| 6,135,189 | A | 10/2000 | Weinreich | |
| 6,644,372 | B1 * | 11/2003 | Judkins | 160/84.04 |
| 6,684,930 | B1 * | 2/2004 | Palmer et al. | 160/170 |
| 6,889,741 | B1 * | 5/2005 | Cheng et al. | 160/170 |
| 2002/0088562 | A1 * | 7/2002 | Palmer | 160/170 |
| 2003/0196765 | A1 * | 10/2003 | Ciuca et al. | 160/170 |
| 2004/0177933 | A1 * | 9/2004 | Hillman et al. | 160/170 |

* cited by examiner

FIG. 1
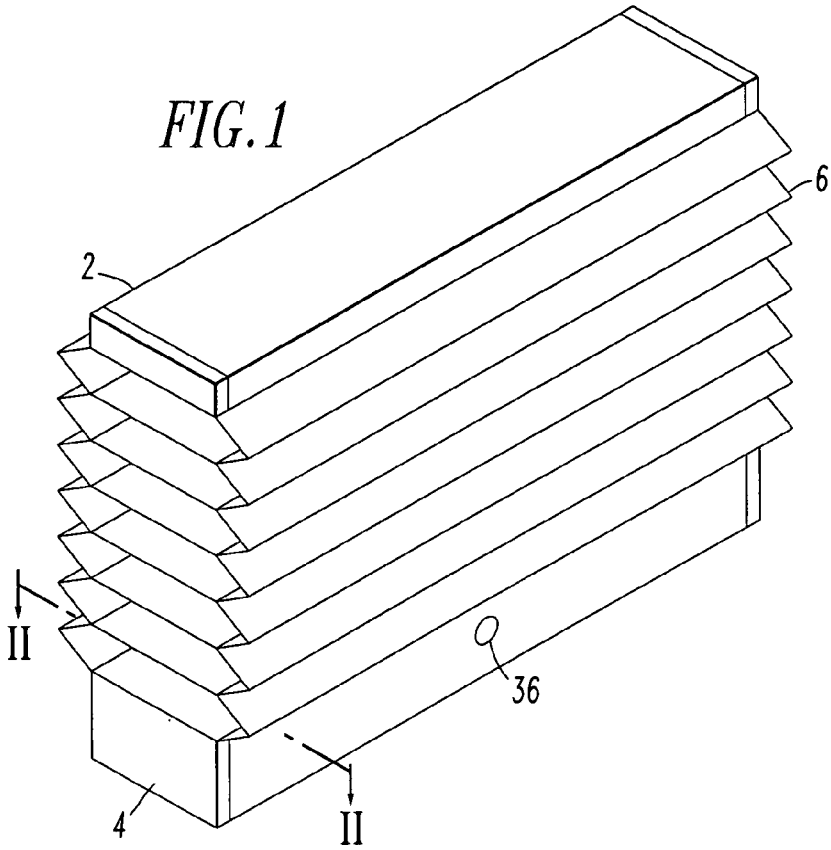
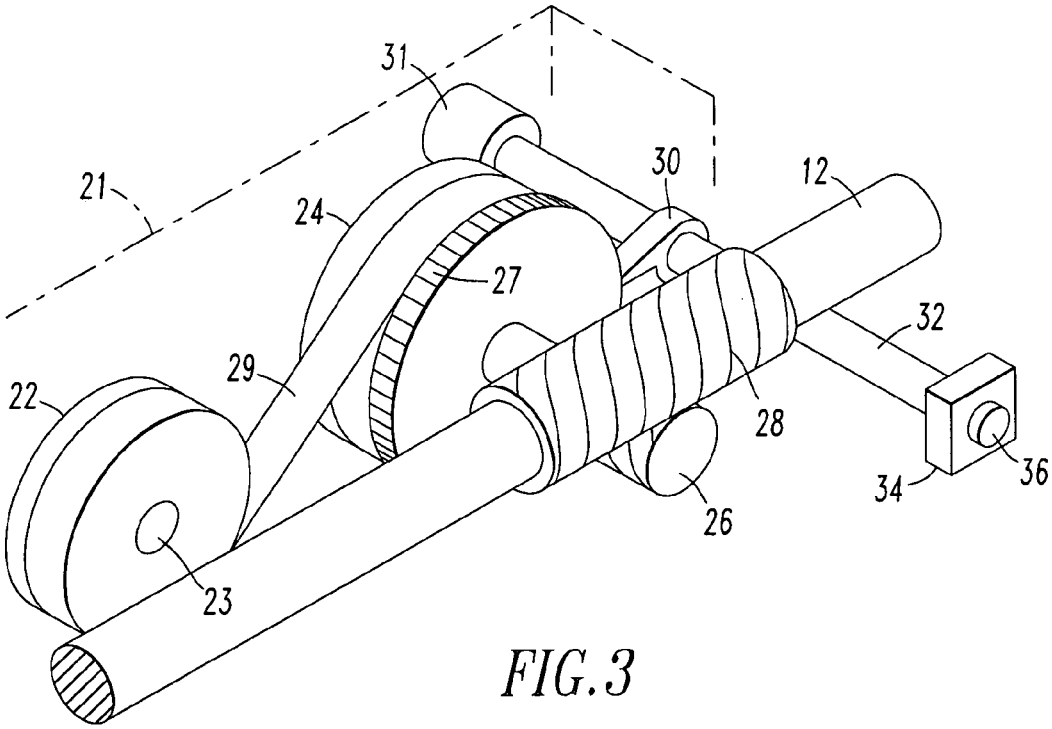
FIG. 3

CORDLESS BLIND WITH LOCK MECHANISM

CROSS REFERENCE TO RELATED APPLICATION

This application is a continuation-in-part of U.S. patent application Ser. No. 09/815,403, filed Mar. 22, 2001, now U.S. Pat. No. 6,644,372.

FIELD OF INVENTION

The invention relates to lift systems for raising and lowering window blinds that have lift cords such as pleated shades, roman shades and venetian blinds.

BACKGROUND OF THE INVENTION

Venetian type blinds have a series of slats hung on ladders that extend from a headrail to a bottomrail. In most venetian blinds a pair of lift cords is provided each having one end attached to the bottomrail and then passing through elongated holes in the slats up to and through the headrail. When the lift cords are pulled downward the blind is raised and when the lift cords are released the blind is lowered. A cord lock is usually provided in the headrail through which the lift cords pass. The cord lock allows the user to maintain the blind in any desired position from fully raised to fully lowered. Pleated shades and roman shades are also raised and lowered by lift cords running from the bottom of the shade into a headrail. The cord lock system and other cord lift systems used in venetian blinds can also be used in pleated shades and roman shades.

Another type of lift system for window blinds utilizes a take-up tube for each lift cord. These tubes are contained on a common shaft within the headrail. Each lift cord is attached to one end of a tube. The tubes are rotated to wind or unwind the lift cord around tubes. This system is generally known as a tube lift system. Some tube lift systems are operated by a continuous loop cord that passes over end of the axle and extends from the headrail.

In recent years the art has been concerned that cords, particularly looped cords, pose a strangulation threat to children who may become entangled in the cords. Consequently, there has been much interest in cordless blinds. These blinds rely on electric motors or spring motors to raise and lower the lift cord. One common cordless blind simply contains a motor connected to a tube collection system within the headrail. Another cordless blind relies upon a constant force spring motor attached to a spool or spools on which the lift cords are collected. This type of cordless blind is disclosed by Coslett in U.S. Pat. No. 5,105,867 and by Kuhar in U.S. Pat. Nos. 5,482,100; 5,531,257 and 6,079,471 and by Wang et al. in U.S. Pat. Nos. 6,012,506, 6,024,154 and 6,029,734.

Coslett discloses a sun shade having a series of blades connected together to form a serrated shape like a pleated shade. The upper blade is mounted within a hollow housing and the lower blade is secured to a plate member. A constant force spring plate is wound around a spring spool member and further engaged to an output spool, both of which are within a hollow handle secured to the hollow housing. A cord is connected to the output spool and passed from the handle through the housing and the blades and is connected to the plate member. Such a cording arrangement is similar to that of a lift cord in a pleated shade or venetian blind. The spring retains the blades in a folded closed position. When the shade is extended the spring exerts tension on the cord. Consequently, Coslett teaches the user to fix the plate member along one side of the window and to provide a hook to retain the hollow housing at the opposite side of the window when the shade is covering the window. Thus, Coslett's shade can be in only one of two positions, fully extended to cover the window or fully retracted. Furthermore, Coslett's blind is not suitable for installation in an orientation in which one rail is fixed at the top of the window frame as is done for most building windows. That is so because when the blind is fully retracted most people could not reach the handle to extend or close the blind without standing on a stool or ladder.

Kuhar discloses a cordless, balanced blind that contains at least one constant variable force spring motor in the headrail. The springs in these motors vary in thickness or in width along their length as they are wound around storage drums. A cord spool is coupled to one or more spring drums. The lift cords of the blind are wound about the spool. Thus, the spring winds or unwinds as the blind is raised or lowered. The difference in width or thickness of the spring compensates for the increasing weight of the blind on the cords as the window covering is raised and the decreasing weight as the blind is lowered. Kuhar teaches that much effort must be made to select and couple the spring motor to the cords so that the bottomrail is balanced at any and every position. Kuhar further teaches that several spring motors may be coupled together.

If the system is not in balance when the operator positions the bottomrail at a desired location, the bottomrail moves upward or downward to a location at which the system is balanced. Consequently, it is not possible to keep the bottomrail at the desired location without adjusting or replacing the spring motors. Several people in the industry have recognized that a solution to the problem is to provide a cord lock or brake that acts on the lift cords or spring motors. Wang et al. in U.S. Pat. No. 6,029,734 disclose a cordless blind with a locating unit provided in the bottomrail which prevents the lift cords from moving until the operator presses a button on the bottomrail. Another lock mechanism which engages the coil springs in a cordless blind is disclosed in U.S. Pat. No. 6,024,154. Both the springs and the lock mechanism are located in the bottomrail. This lock mechanism is also biased to a locked position. The bottomrail can be raised and lowered only while the lock button is being pressed to disengage the lock. Palmer in Published United States Patent Application 2002/0088562 discloses a one way brake which prohibits the bottomrail from moving toward the headrail, but permits the bottomrail to be moved away from the headrail by an operator. The brake must be released by pushing a button or lever in the bottomrail to raise the bottomrail. All of these cordless blinds require the operator to hold the lock button or lever to move or raise the bottomrail. If such a blind is installed in a tall window many people would be unable to reach a fully raised blind without climbing on a ladder or chair. Even if the blind were in a standard window, short people would not be able to fully raise the blind without using a ladder. Operators would also have difficulty fully raising such a blind if a couch or other furniture were in front of the window.

SUMMARY OF THE INVENTION

I provide a cordless blind containing one or more springs in the bottomrail or moving rail of the blind. Preferably the spring is a constant force spring motor of the type disclosed by Coslett and Kuhar. The spring motor is connected to at least one cord collector in a manner to maintain tension on the cord collector. The tension causes the lift cords to be collected on the cord collector when the cord collector and the lift cords are free to move, thereby moving the bottomrail toward the headrail. I further provide a lock mechanism attached to the cord collector or the lift cords. The lock mechanism has a locked position wherein the lift cords are restrained from being collected on the cord collector, or from being removed from the cord collector, or both. The lock mechanism also has an unlocked position that allows the cord collector and plurality of lift cords to move freely. The lock mechanism can be in either a locked position in which the bottomrail will not move in at least one direction, or in an unlocked position, which allows the bottomrail to move upward or downward freely. The lock mechanism is positioned in the bottomrail or moving rail and is designed so that the operator is not required to hold a button to keep the lock in an unlocked position.

A first present preferred embodiment of the lock mechanism has a rotary-cam mechanism similar to those used in ball-point pens. Pressing a button once changes the lock mechanism from a locked position to an unlocked position. Pressing the button again changes the lock from an unlocked position to a locked position.

A second present preferred embodiment of the lock mechanism has a pair of buttons that move a locking arm between a locked position and an unlocked position. The end of the arm has a tooth which engages a gear attached to the spring motor or cord collector when the lock is in a locked position.

A third present preferred embodiment of the lock mechanism is similar to the second but has a lever that is moved from side to side to engage or release the locking arm. In each of these embodiments one could substitute a sprocket for the locking arm. Pressing the button or lever would move the sprocket from the unlocked position to the locked position.

A fourth preferred embodiment of the lock mechanism utilizes a ratchet type lock similar to that used in roller shades. However, in this lock a movable lever, rather than pawl, engages the sprocket. The lever extends from the bottomrail. Moving the lever in one direction fully disengages the lever from the sprocket. Moving the lever in an opposite direction engages the sprocket.

A fifth embodiment of the lock mechanism has a locking arm activated by buttons or a lever that engages a ratchet that is attached to the spring motor or cord collector. The ratchet functions as a one way lock when engaged by the locking arm. In this condition the lift cords can move in only one direction allowing the shade to be raised or allowing the shade to be lowered. When the locking arm is disengaged, the bottomrail is free to move in either direction.

A cord or wand could be attached to the button or lever in any of these embodiments to permit operation of the lock mechanism when the bottomrail is beyond the reach of the operator. A clip or magnet can be provided to nest the cord or wand against the bottomrail when the blind is in a fully-lowered or partially-lowered position.

The embodiments that utilize a lever could also have a retractable operator cord. In this version, an operator cord is provided on a spool within the bottomrail. A motor or clutch mechanism is attached to the spool and allows the cord to play out of the bottomrail when the bottomrail is a selected distance from the headrail. An operator may then use the cord to further raise or lower the blind. When the bottomrail is a second related distance from the headrail, the operator cord is retracted into the bottomrail.

The cordless blind of the present invention is easy to operate. A user simply presses the button or lever, moves the bottomrail or moving rail to a desired position, and presses the button or lever again to lock the lock mechanism. Because the lift cords and cord collector are no longer free to move, the bottomrail stays in the desired position. When the bottomrail is beyond the reach of the user a cord or wand can be used to operate the lock mechanism. Consequently, the operator can place the bottomrail or moving rail at any desired location between a fully raised position and a fully lowered position.

This cordless blind could be a pleated shade, a cellular shade, a roman shade or a venetian blind. If the shade is a venetian blind I prefer to provide ladders in which the rails of the ladders are connected to form a continuous loop. Then the slats can be tilted with a conventional tilt mechanism in the headrail.

BRIEF DESCRIPTION OF THE FIGURES

FIG. 1 is a rear perspective view of a present preferred embodiment of my cordless blind.

FIG. 3 is an enlarged view of the spring motor in the embodiment shown in FIGS. 1 and 2.

DESCRIPTION OF THE PREFERRED EMBODIMENTS

Figure 2:
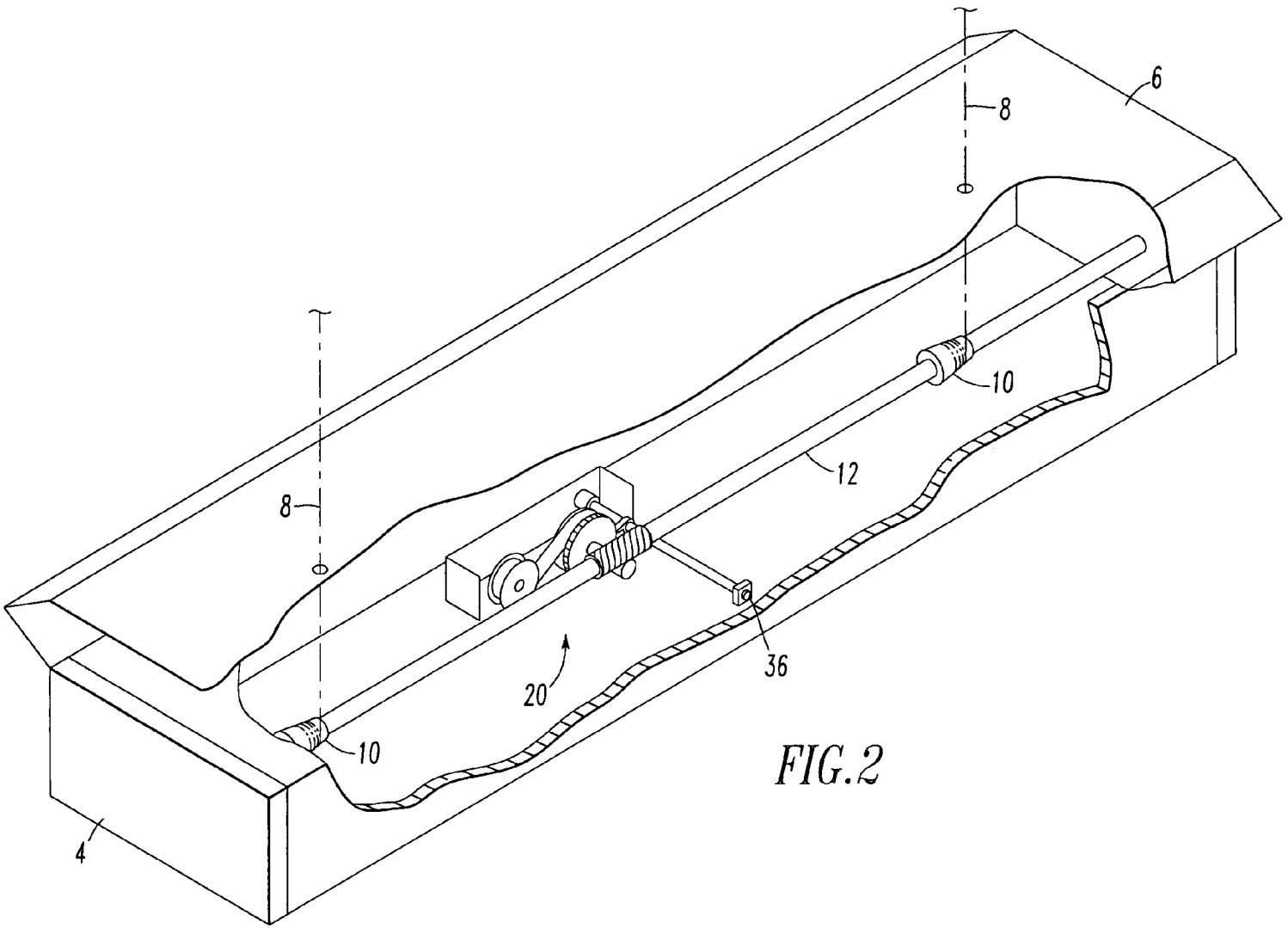
FIG. 2 is a sectional view taken along the line II—II of FIG. 1 wherein a portion of the front wall of the bottomrail has been cut away.

A present preferred embodiment of my cordless blind or shade shown in FIG. 1 is comprised of a headrail 2, a bottomrail 4 and a window covering material such as cellular material 6 connected between the headrail and the bottomrail. The window covering material could also be a single panel of pleated material, roman shade material or a set of slats carried on ladders, as in a venetian blind. The blind could be any width or length, and likely would be larger than the blind shown in FIG. 1. Lift cords 8 are fixed within the headrail, pass through the window covering material and into the bottomrail. Although only two lift cords 8 are shown in FIG. 2 it should be understood that the cordless blind could have more lift cords with the number of lift cords being related to the width of the blind. The lift cords 8 are collected on cones 10 within the bottomrail. The cones each have a central bore that enables them to be mounted on a common axle 12. The axle 12 is coupled to a spring motor 20 shown in detail in FIG. 3. If desired the cones could be omitted and the cords could be wrapped on the axle.

In a standard tube lift the lift cord is wound about a cylindrical tube or cylindrical axle. Consequently, each rotation of the axle will collect or release a length of cord equal to the circumference of the tube which can be calculated from the equation $L=\pi dn$ where d is the outside diameter of the tube plus the diameter of the cord and n is the number of revolutions. In blinds for standard residential and commercial windows the axle may rotate 40 or more times to fully raise or lower the blind. All window blinds that have lift cords will have at least two lift cords and each lift cord is wound on a separate tube. Although all tubes and cords are supposed to be the same diameter, one tube or cord often is larger than the diameter of another tube or cord with differences in diameters often being 0.005 inches and may be as much as 0.010 inches. Since the spool will rotate as many as eighty to over a hundred times to fully lower the blind, that means one lift cord will be lowered 0.4 inches more than the other lift cord. A difference of 0.25 inches is noticeable to a person looking at the blind or shade. Hence, if there is a difference in diameters in the cords or the axles the bottom of the shade will appear to be tilted. If the blind has more than two cords and the short cord is in the middle the bottomrail acts like a teeter-totter pivoting about the short middle cord and the whole blind oscillates as the blind is being raised or lowered.

In the lift system shown in FIG. 2 the total length of lift cord that will be released is determined by the equation:

$$L = \frac{\pi d_1 - d_2}{2}$$

Because a cone offers a series of different diameters a fabricator can position the cones on the axle so that the lift cords begin wrapping at different locations on the cones. Consequently, the fabricator can compensate for variations among cones and cords. The result is that every blind can be fabricated so that the bottom of the blind is level when the blind is fully lowered. The fabricator can adjust the position of the cord simply by rotating the cone relative to the axle.

Referring to FIGS. 2 and 3 the spring motor 20 has a bracket 21 on which a storage drum 22 and an output drum 24 are rotatably mounted in a spaced apart relationship. The storage drum is free to rotate about axle 23. When the output drum 24 rotates it turns axle 25 and attached worm gear 26. Output drum 24 has gear teeth or an attached gear 27 that engages pawl 30. When worm gear 26 turns, worm gear 28 on shaft 12 will also turn turning the shaft 12. A spring 29 is coupled between the storage drum 22 and the output drum 24. The spring provides a constant tension on the lift cords acting through the axles 23 and 12 and gears 26 and 28. The spring 29 may be configured in one of several ways to provide the desired tension. The first configuration has a constant thickness throughout the length of the spring. One end of the spring is narrower than the opposite end of the spring with the width gradually increasing or decreasing form one end to the other end. The narrow end is attached to the center of the storage drum 22 and the wider end attached to the center of the output drum. The spring is wound from one drum to the other in an opposite coil orientation. As the spring 29 is transferred from the storage drum 22 to the output drum 24, the width of the spring between the two drums will decrease and the spring will be wound oppositely to its original coil shape. Another embodiment of the spring varies in thickness from one end to the other end but has a constant width. The thinner end is attached at the core of the storage drum. The thicker end is attached to the core of the output drum. As in the first configuration, the orientation of the spring as it is transferred from the storage drum to the output drum is reversed. A third possible configuration is for the spring to vary in both width and thickness. Also, a laminated coil spring could be used.

A control shaft 32 extends from hub 31 to a control box 34. The control shaft carries a pawl 30 having teeth that will mesh with gear teeth 27 on drum 24. Control shaft 32 may not rotate but can move transversely along its centerline. Consequently, when pawl 30 engages the teeth 27 on drum 24, the drum as well as the spring motor and the lift cords will not move. Button 36 controls movement of control shaft 32. In one configuration a rotary-cam mechanism is provided within hub 31 or control box 34. Pushing the button once will cause the pawl to move away from the teeth on drum 24. The pawl will stay in that unlocked position until the button is pressed again. The second push of the button moves shaft 32 returning the pawl 30 to the locked position in engagement with teeth 27 on drum 24. Rotary-cam mechanisms are well-known in the art and commonly used in ball-point pens. Examples of rotary-cam mechanisms used in ball-point pens are disclosed in U.S. Pat. Nos. 5,263,786; 5,915,866 and 5,997,204 whose teachings are incorporated herein by reference. Rather than providing a button and rotary-cam to activate the lock, a knob could be used as the lock activator. Turning the knob would move pawl 30 into and away from the teeth to drum 24.

In the embodiment shown in FIGS. 1 through 3 the lock mechanism is connected directly to the spring motor. As will be apparent from the discussion of other preferred embodiments, the lock mechanism could be connected to the cord collector or act directly on the cords.

Figure 4:
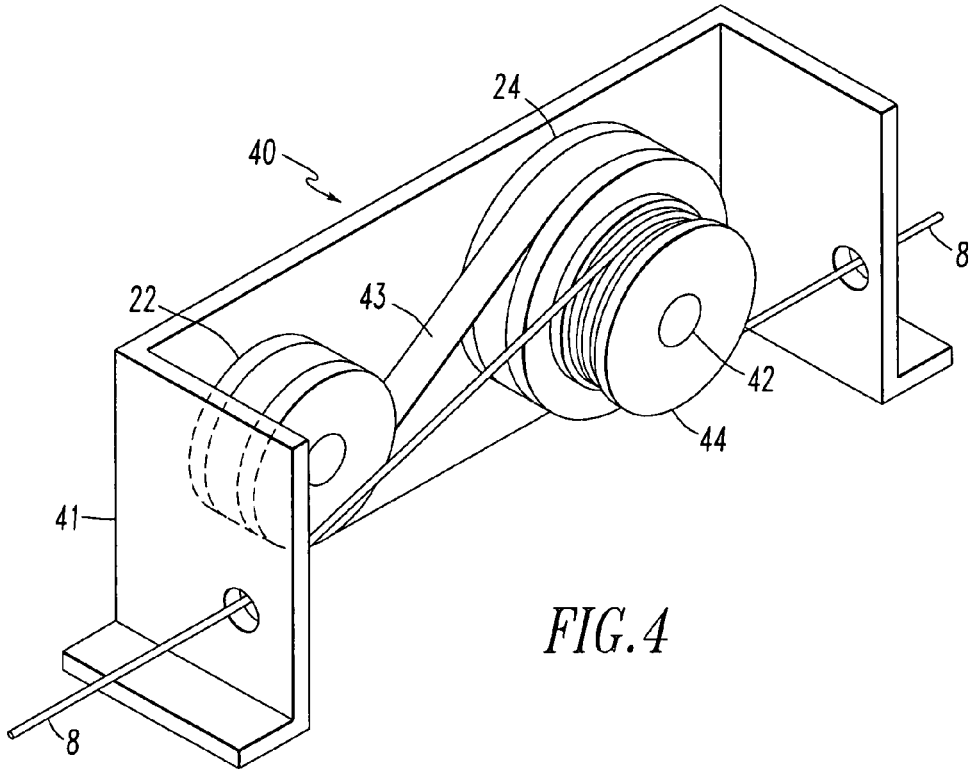
FIG. 4 is a perspective view similar to FIG. 3 of an alternative spring motor that can be used in the cordless blind of the present invention.

Several other configurations of spring motors can be used. The spring motor 40 of FIG. 4 has a storage drum 22 and a take up drum 24 carried on a bracket 41 with a spring 43 connected between them. This spring can be any of the springs described as suitable for use in the first embodiment and operates in the same manner. In this embodiment the lift cords 8 are collected on a spool 44 carried on a common axle 42 with the take up drum 24. Consequently, the take up drum 24 and the spool 44 will turn together in the same direction. As in the first embodiment there is a lock mechanism (not shown) that is connected to the take up drum or spool 44 through a gear mechanism or other suitable means.

Figure 5:
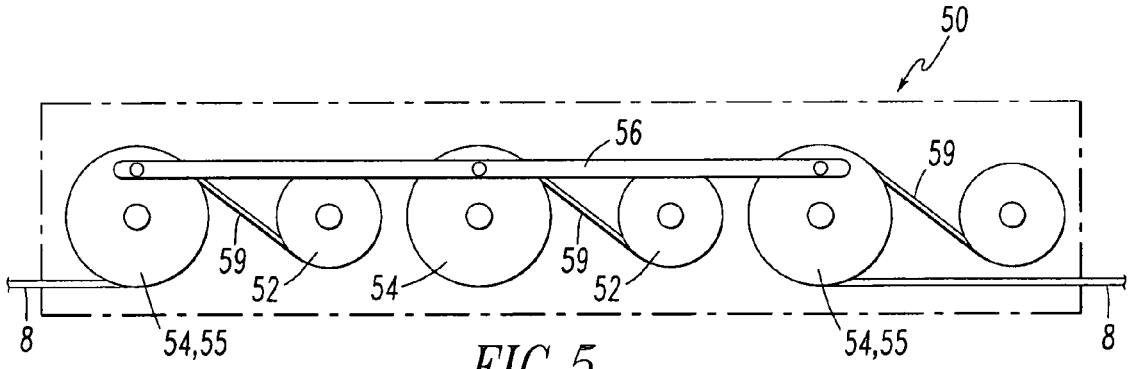
FIG. 5 is a front view of three interconnected spring motors that can be used in the cordless blind of the present invention.

Another spring motor configuration is illustrated in FIG. 5. This spring motor 50 has three take-up drums 52 each carrying a spring that is also connected to an associated storage drum 54. A link 56 connects the take up drums together. The lift cords are wound on spools connected to a respective storage drum. This spool and take up drum configuration is similar to the spool 42 and take up drum 24 shown in FIG. 4. In the embodiment of FIG. 5 the spools are behind the take up drums and thus are not visible in the figure. A spring 59 is connected between each storage drum 54 and take up drum 52 pair. This spring can be any of the springs described as suitable for use in the first embodiment and operates in the same manner. A lock mechanism (not shown) is connected to at least one of the storage drums or spool. The lock mechanism operates in the same manner as the lock mechanism described in the embodiment of FIGS. 1, 2 and 3.

Figure 6:
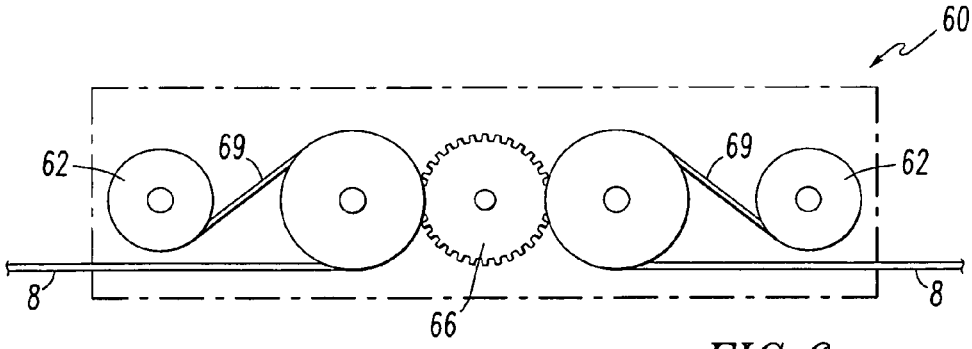
FIG. 6 is a front view of two interconnected spring motors that can be used in the cordless blind of the present invention.

Yet another spring motor configuration is shown in FIG. 6. The spring motor 60 has two take-up drums 62 each carrying a spring 69 that is also connected to an associated storage drum 64. This spring can be any of the springs described as suitable for use in the other embodiments and operates in the same manner. The two storage drums have gear teeth or an associated gear that meshes with gear 66. Thus, the two storage drums will turn simultaneously but in opposite directions. A lock mechanism (not shown) is connected to the gear 66 or to at least one of the storage drums or spool. The lock mechanism operates in the same manner as the lock mechanism described in the embodiment of FIGS. 1, 2 and 3.

Figure 7:
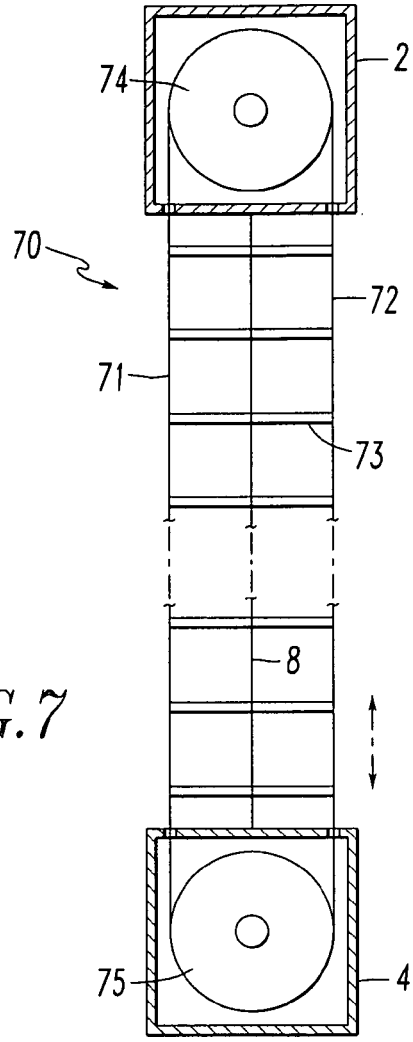
FIG. 7 is an end view of a ladder and associated pulleys that can be used when the cordless blind of the present invention is configured as a venetian blind.

In the event that the cordless blind is a venetian type blind I prefer to configure the ladders as shown in FIG. 7. Those ladders 70 have opposite rails 71, 72 having rungs between them that carry slats 73. The ends of the rails 71, 72 are connected together to form a loop. Pulleys 74 and 75 in the headrail 2 and the bottomrail 4 are positioned at either end of the loop and support the ladder. The slats can be tilted by pulling one of the ladder rails up or down as indicated by the double-headed arrow or a conventional tilt mechanism can be provided in the headrail.

Figure 8:
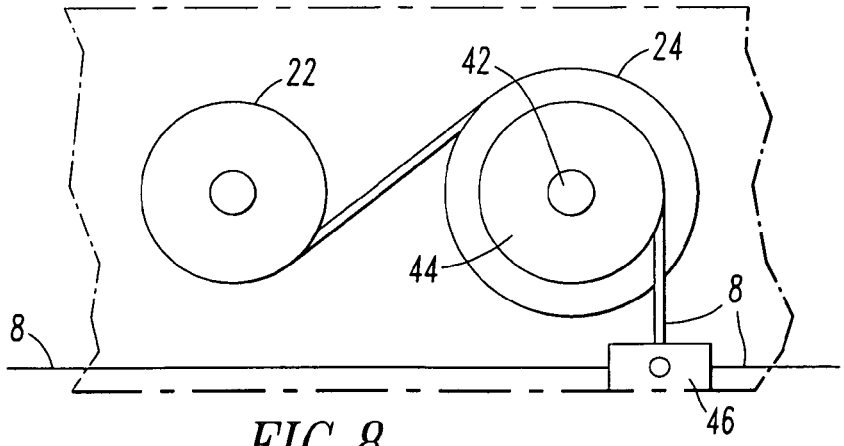
FIG. 8 is a front view of an alternative motor and lock mechanism for a second present preferred embodiment of my cordless blind.
Figure 9:
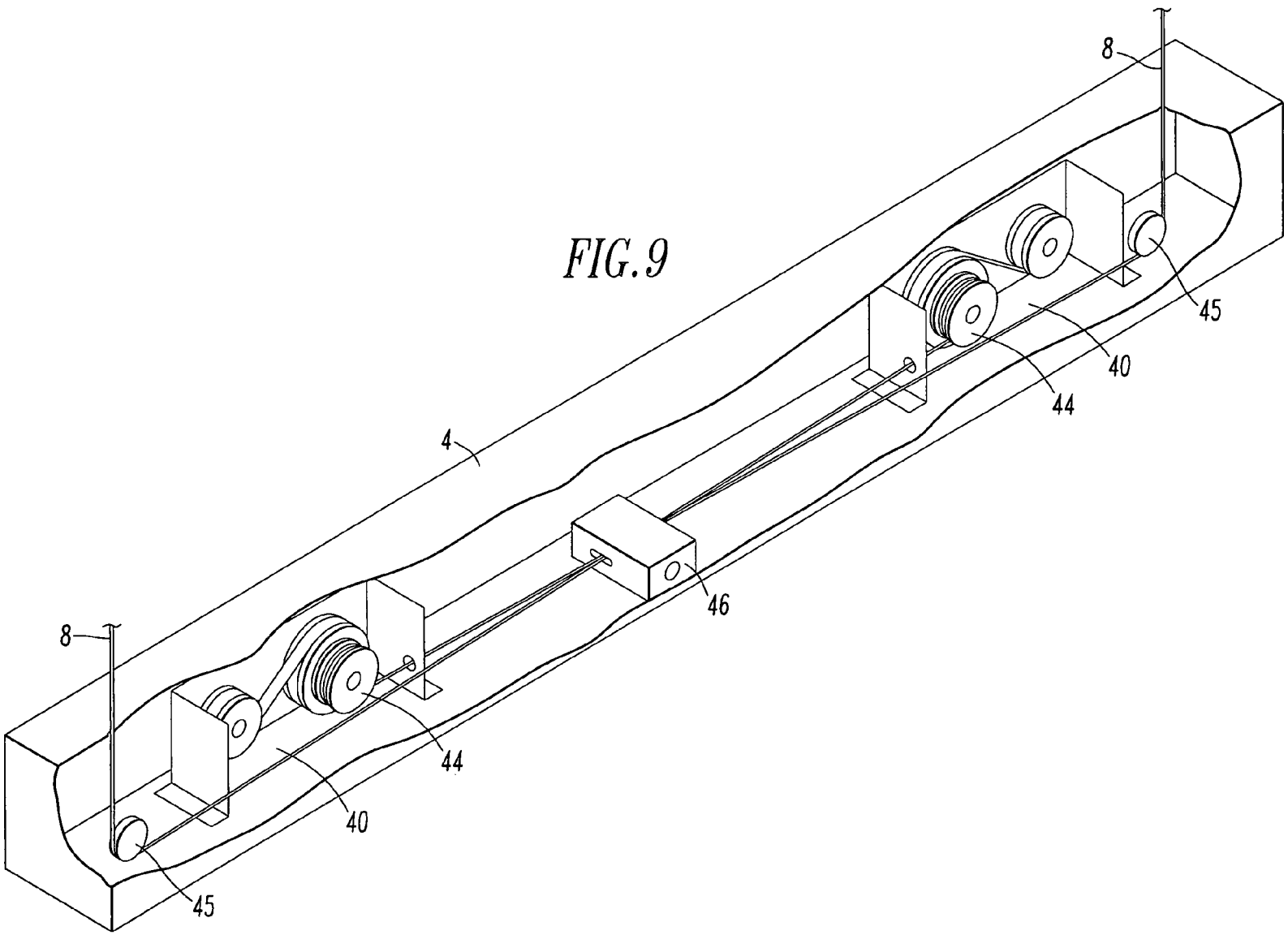
FIG. 9 is a perspective view of a bottomrail partially cut away to show for a third present preferred embodiment of my cordless blind.

Second and third present preferred embodiments of my cordless blind utilize a cord lock in conjunction with one or more spring motors. The spring motor and lock mechanism for the second embodiment shown in FIG. 8 has a single spring motor with a take up drum 24 and storage drum 22. A cord collector spool 44 is carried on the same axle 42 that carries take up drum 24. Consequently, the spring motor will try to wind the lift cords 8 onto the spool 24. The lift cords are routed through a cord lock 46. When the cord lock is in a locked position, the lift cords cannot be wound onto the spool. When the cord lock is unlocked the spring motor will wind the lift cords onto the spool raising the blind. Furthermore, while the cord lock is unlocked a user could pull the bottomrail down overcoming the force of the spring motor and lowering the blind. The cord lock 46 may contain a rotary-cam lock mechanism that acts directly on the cords. The third present preferred embodiment has a bottomrail illustrated in FIG. 9 containing two spring motors 40 similar to the motor shown in FIGS. 4 and 8. The lift cords 8 are routed through the bottomrail, over a pulley 45, through a cord lock 44 to a spool on the spring motor 40. This cord lock may contain a rotary-cam lock mechanism that acts directly on the lift cords 8.

Figure 10:
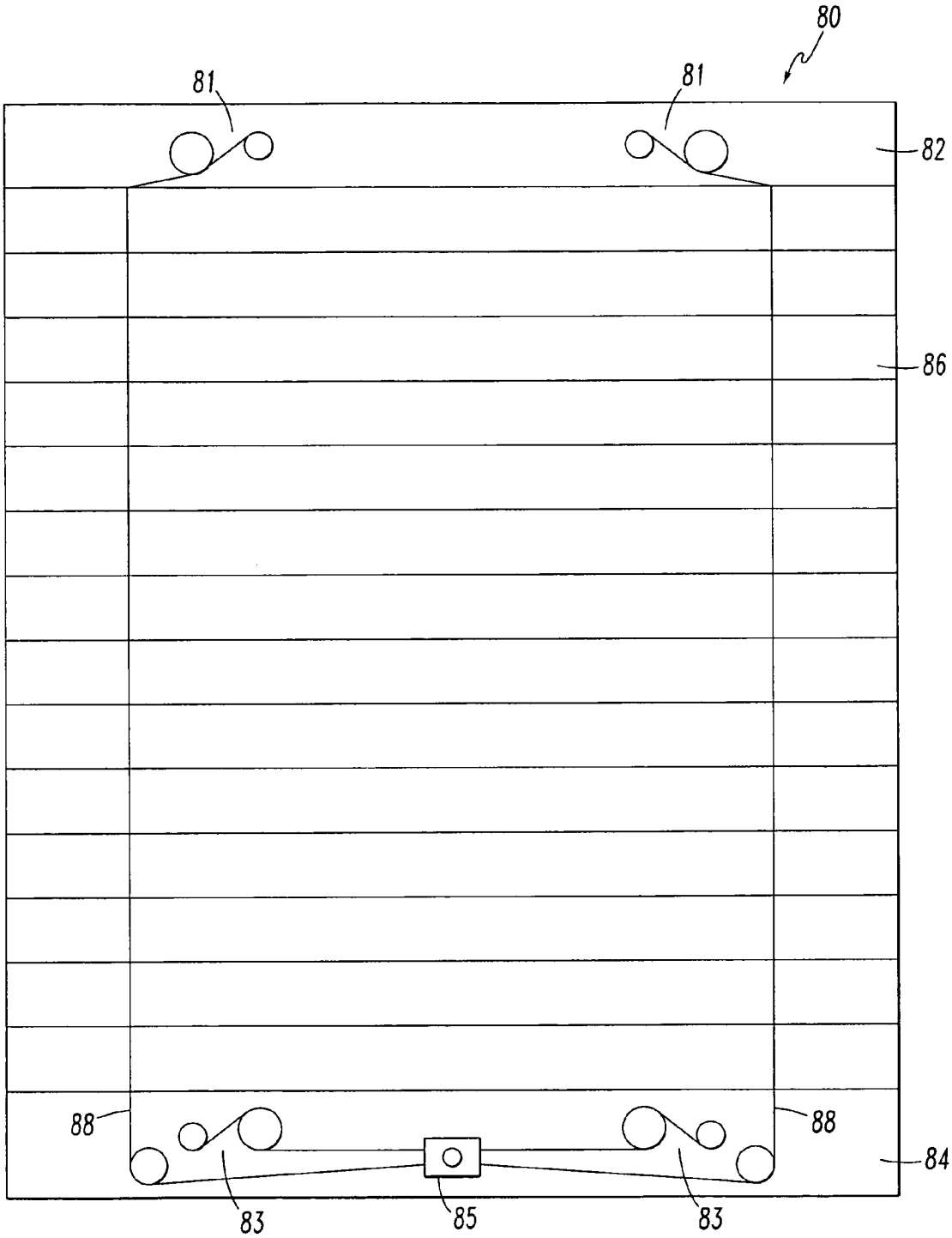
FIG. 10 is a schematic representation of a fourth present preferred embodiment of my cordless blind.

A fourth present preferred embodiment of my cordless blind is illustrated by the schematic of FIG. 10. That blind 80 has a headrail 82, bottomrail 84 and window covering material 86 connected between the headrail and bottomrail. Spring motors 81 and 83 are provided in both the headrail and the bottomrail. The spring motors 81 in the headrail are sized so as to be unable to lift the blind without the help of the spring motors 83 in the bottomrail 84. Lift cords 88 are connected to the spring motors 81 in the headrail as well as the spring motors in the bottomrail 84. The lift cords 88 pass through a cord lock 85 that operates like the cord lock in the embodiments of FIGS. 8 and 9.

It should be noted that in all of the embodiments disclosed thus far the button or other lock activator that operates the lock mechanism extends from the bottomrail. Consequently, no operator cords or wands are needed to operate the blind. The button is easily reached when the blind is partially lowered or in a fully lowered position. However, when the blind is fully raised, an operator may be unable to reach the button without climbing on a ladder or chair. That disadvantage can be overcome by using the lock mechanisms hereinafter described.

Figure 11:
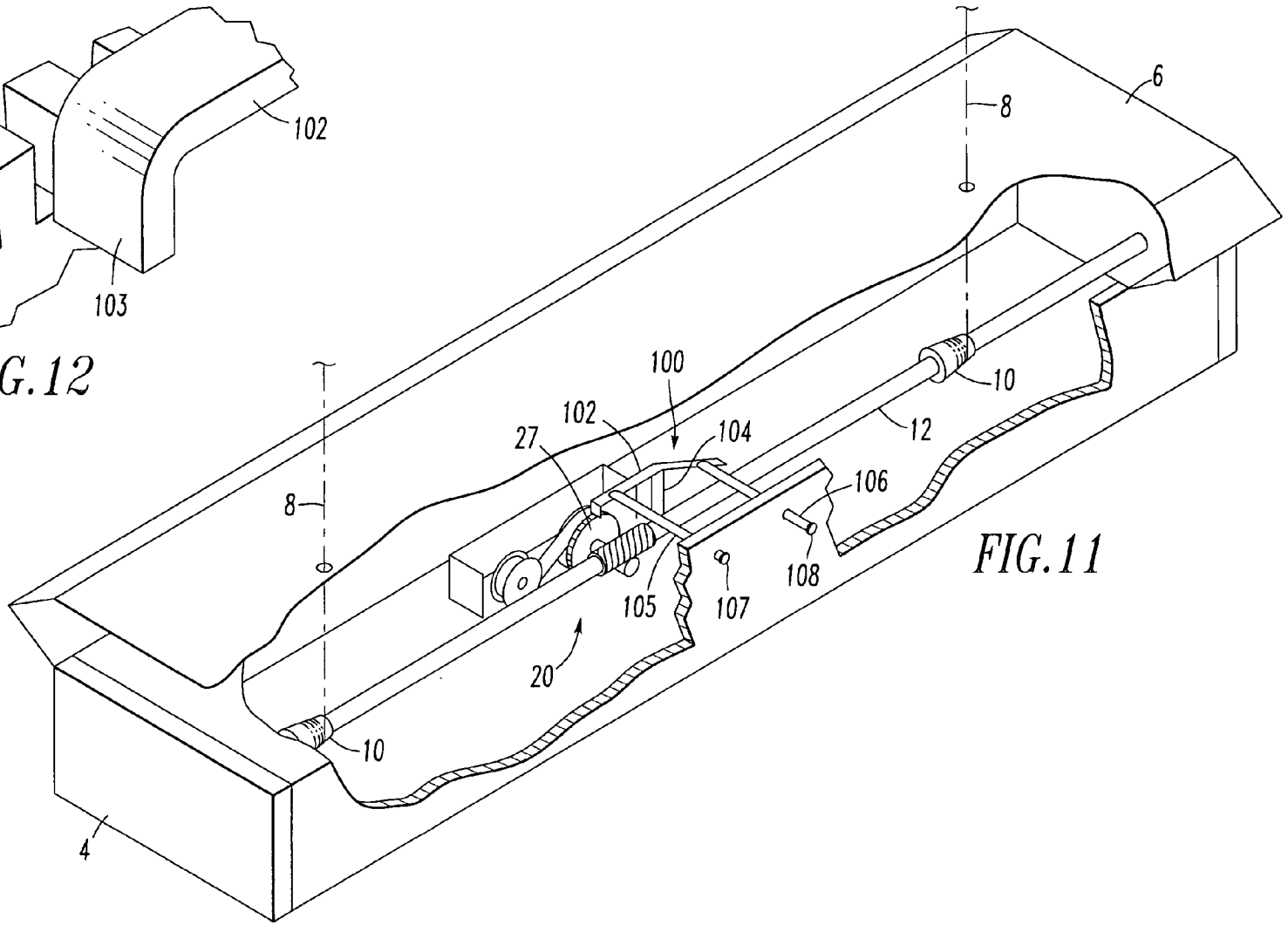
FIG. 11 is a perspective view similar to FIG. 2 showing a second preferred lock mechanism in a cordless blind.
Figure 12:
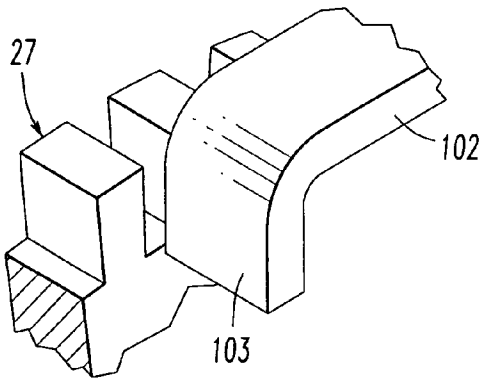
FIG. 12 is a fragmentary view of the end of the locking arm used in the lock mechanism illustrated in FIG. 11.

A second present preferred locking mechanism 100 is shown in FIGS. 11 and 12. This locking mechanism can be used in conjunction with a gear 27 provided in the spring motor 20 as shown in FIG. 11. The lock mechanism can also be used in those blinds having a gear attached a cord spool or a gear connecting several spring motors as illustrated in FIG. 6. In lock mechanism 100 there is a locking arm 102 having a tooth 103 which is sized to fit between gear teeth in gear 27. The locking arm is pivotably mounted in the bottomrail on post 104. Rods 105 and 106 extend from the locking arm 102. A button 107, 108 is provided on each of the rods 105 and 106. Rods 105 and 106 are positioned so that when button 107 is pushed the locking arm will be in engagement with gear 27 preventing the spring motor and the cord collectors 10 on shaft 12 from turning in either direction. When button 108 is pressed the locking arm 102 pivots on post 104 to become disengaged from gear 27. Then, the spring motor 20 and shaft 12 on which cords 8 are collected are free to move in either direction. It should be apparent to those skilled in the art that one could substitute a sprocket or a gear for locking arm 102. A button, lever or knob could be provided to alternately engage or disengage the sprocket from gear 27. This could be done by moving the sprocket into and away from engagement of gear 27. Another option is to provide a sprocket with missing teeth such that turning the sprocket will cause the sprocket to alternately engage and then disengage gear 27.

Figure 13:
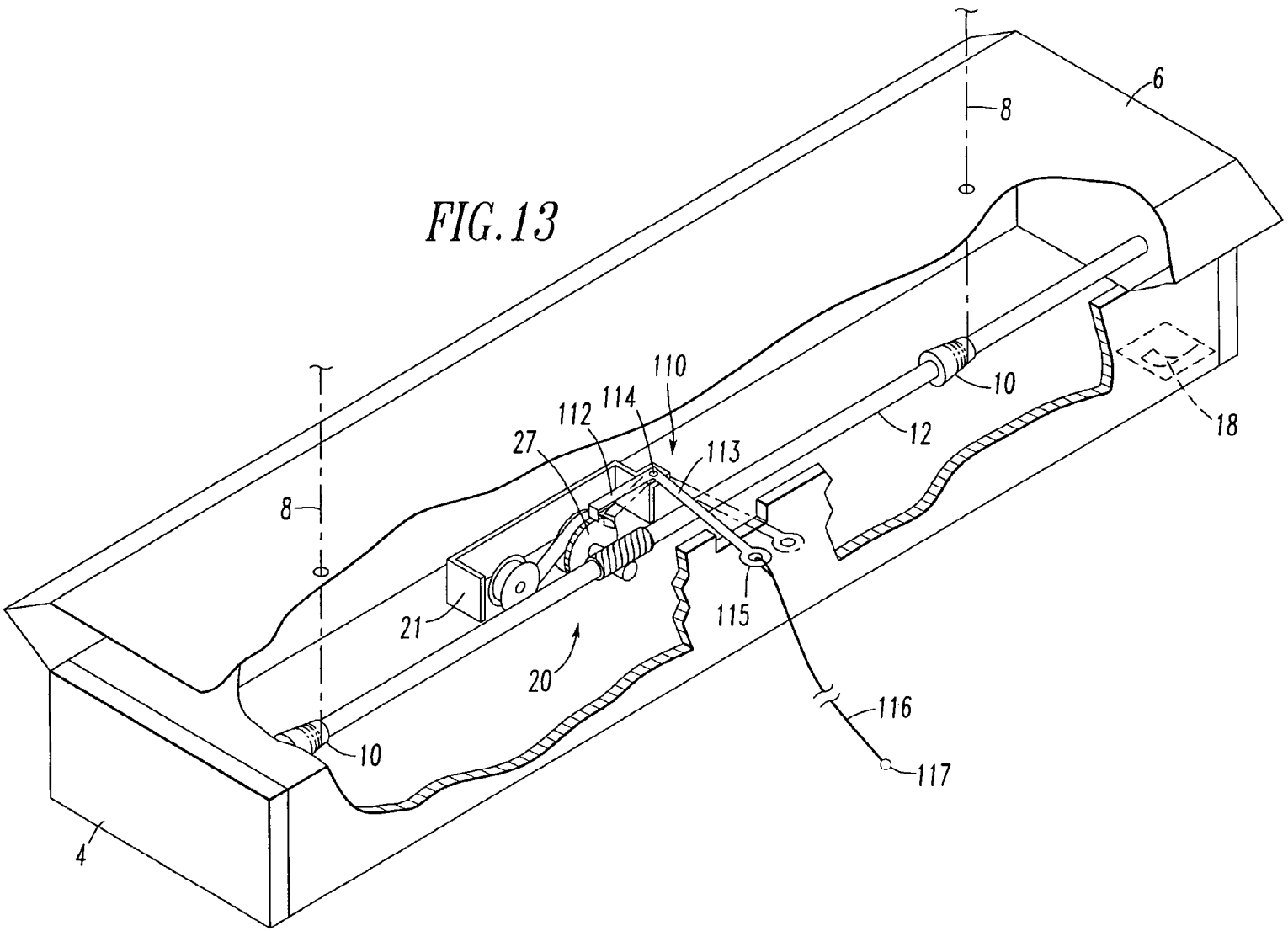
FIG. 13 is a perspective view similar to FIGS. 2 and 11 showing a third present preferred lock mechanism in a cordless blind.
Figure 14:
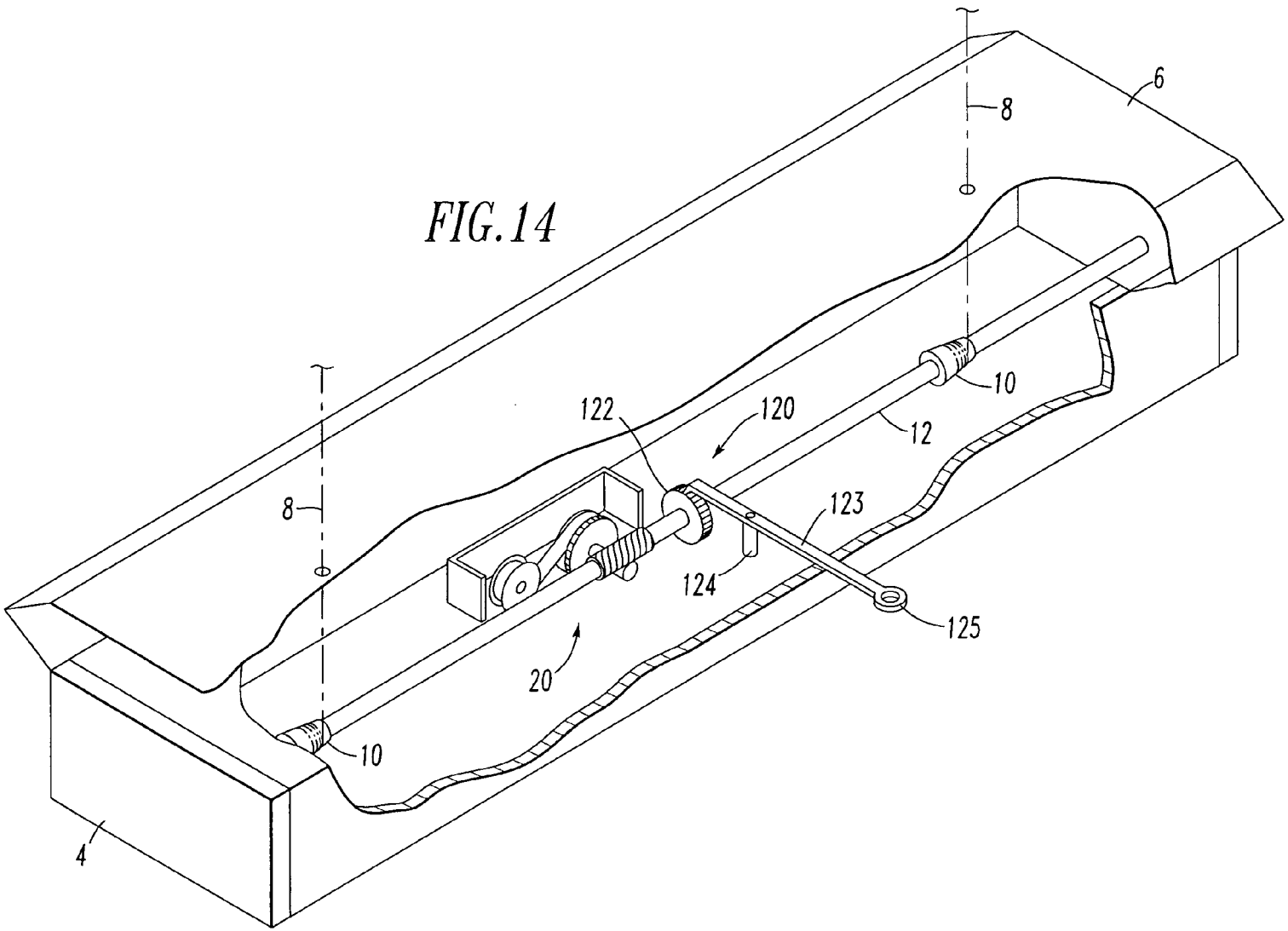
FIG. 14 is a perspective view similar to FIGS. 2, 11 and 13 showing a fourth present preferred lock mechanism in a cordless blind.

A third present preferred lock mechanism 110 shown in FIG. 13 has a locking arm 112 similar to locking arm 102 in the embodiment of FIG. 11. In the lock mechanism 110 a lever 113 is attached to the locking arm. This assembly is attached to the spring motor bracket 21 by pivot pin 114. To disengage the lock mechanism from gear 27 an operator moves the lever and locking arm to the position shown in dotted line in FIG. 13. I prefer to provide an eyelet 115 at the end of the lever to which a cord 116 or wand (not shown) could be attached. A magnet 117 is provided at the end of the opposite cord 116. An operator may choose to attach the free end of the cord to the bottomrail 4 with magnet 117. Alternatively, a clip 118 shown in dotted line can be provided for attaching the cord 116 to the bottomrail when the cord is not in use. One could substitute a wand (not shown) for cord 116. The wand could be secured by a magnet or a clip in the same manner as cord 116. One advantage of this lock mechanism is that it can be operated while the bottom rail is beyond the reach of the operator. When so positioned the operator can use cord 116, or a wand used in place of cord 116, to move the lever 113 from the locked position to the unlocked position. The lock mechanism 120 shown in FIG. 4 has a ratchet 122 provided on shaft 12. This ratchet operates in the same manner as the ratchet system in a roller shade. However, instead of a pawl I provide a lever 123 supported on post 124. The lever 123 is pivotally attached to post 124. Therefore, moving the lever from side to side alternately engages and disengages the lever from ratchet 122. I prefer to provide a eyelet 125 on the end of the lever to receive an operator cord or wand.

Figure 15:
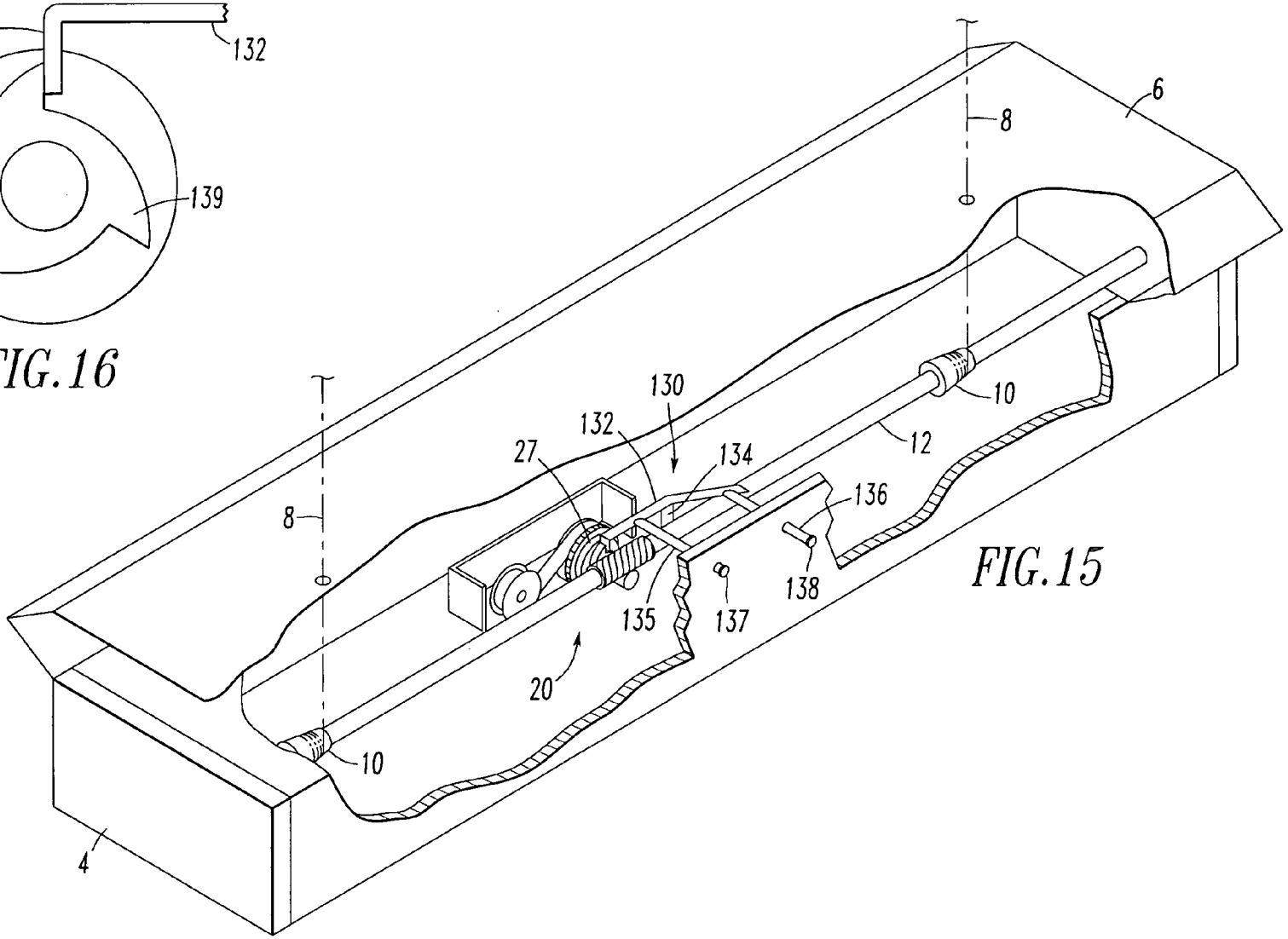
FIG. 15 is a perspective view similar to FIGS. 2, 11, 13 and 14 showing a fifth present preferred lock mechanism in a cordless blind.
Figure 16:
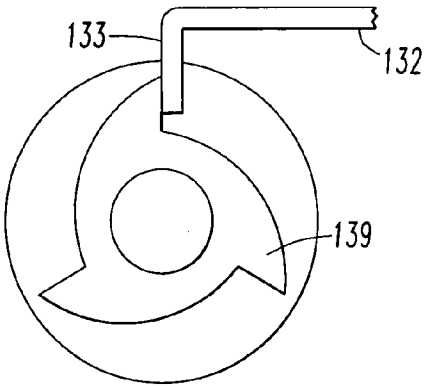
FIG. 16 is a side view of the ratchet and end of the locking arm used in the embodiment of FIG. 15.

The lock mechanism shown in FIGS. 15 and 16 is similar to the lock mechanism of FIG. 11. This lock mechanism 130 has locking arm 132 pivotally mounted on post 134. Rod 135, having button 137, and rod 136, with button 138, are attached to the locking arm 132. In this embodiment a ratchet 139 is attached to the face of gear 27. When the locking arm is in the locked position tooth 133, of the locking arm 132 engages the ratchet 139 as shown in FIG. 16. The ratchet is configured such that when engaged by tooth 113 of locking arm 132, the ratchet can turn in a counterclockwise direction, but is restrained from movement in a clockwise direction. Of course, one could configure ratchet 139 to permit movement in a clockwise direction and restrain movement in a counterclockwise direction. When button 137 is pressed, locking arm 132 will engage ratchet 139 as shown in FIG. 16. Then, the spring motor and cords are free to move in only one direction. Pressing button 138 disengages locking arm 132 from ratchet 139. When the locking arm is disengaged, the spring motor and lift cords are free to move in either direction.

The embodiments illustrated in the drawing are top stacking blinds having a fixed headrail and movable bottomrail. However, the invention is not limited thereto. The blind could be a bottom stacking blind in which the top rail moves and the bottomrail is fixed. The blind could also be a top-down, bottom-up blind having a headrail, a bottomrail and a moving rail. The lock mechanism could be located in the moving rail or the bottomrail. In all these shades there is a first rail and a second rail with the lock mechanism being located in a rail that moves.

Although I have shown certain present preferred embodiments of my cordless blind it should be distinctly understood that the invention is not limited thereto, but may be variously embodied within the scope of the following claims.

The invention claimed is:

1. A cordless blind comprising:

a. a first rail;

b. a second rail;

c. a window covering material connected between the first rail and the second rail;

d. a plurality of lift cords each attached to the first rail and passing into the second rail;

e. at least one cord collector about which at least one of the lift cords is wound;

f. a spring motor connected to the at least one cord collector; and g. a lock mechanism connected to at least one of the cord collector, the spring motor and the plurality of lift cords, the lock mechanism having a locked position, wherein at least one of the plurality of lift cords are restrained from at least one of being collected on the cord collector and being removed from the cord collector, and an unlocked position that allows the cord collector and plurality of lift cords to move freely, the lock mechanism having a lock activator which, when acted upon by a force will change the lock mechanism from the locked position to the unlocked position and when acted upon by the force again will change the lock mechanism from the unlocked position to the locked position, the lock mechanism remaining in the respective locked position and unlocked position after each time that the force is removed.

2. The cordless blind of claim 1 wherein the lock activator is at least one of a button, a lever and a knob.

3. The cordless blind of claim 1 also comprising a gear attached to the at least one cord collector and a sprocket attached to the lock activator, the sprocket engaging the gear when the lock mechanism is in the locked position and the sprocket not engaging the gear when the lock mechanism is in the unlocked position.

4. The cordless blind of claim 1 also comprising a gear attached to the spring motor and a locking arm attached to the lock activator, the sprocket engaging the gear when the lock mechanism is in the locked position and the sprocket not engaging the gear when the lock mechanism is in the unlocked position.

5. The cordless blind of claim 1 also comprising a cord or wand attached to the lock activator.

6. The cordless blind of claim 5 also comprising a fastening means attached to the cord or wand for attaching the cord or wand to the second rail.

7. The cordless blind of claim 6 wherein the fastening means is comprised of a magnet.

8. The cordless blind of claim 5 also comprising a clip attached to the second rail, the clip configured to receive the cord or wand.

9. The cordless blind of claim 1 wherein the lock mechanism comprises a rotary-cam mechanism.

10. The cordless blind of claim 1 wherein the lock mechanism is comprised of a ratchet.

11. The cordless blind of claim 10 wherein the lock activator comprises a lever connected to the ratchet.

12. The cordless blind of claim 1 wherein the lock mechanism is comprised of a locking arm and the lock activator is comprised of two buttons each connected to the locking arm.

13. The cordless blind of claim 1 wherein the window covering material is selected from the group consisting of pleated fabric, pleated film, cellular fabric and cellular films.

14. The cordless blind of claim 1 wherein the window covering material is comprised of a plurality of ladders carrying slats.

15. The cordless blind of claim 1 wherein the window covering material is fabric configured as a roman shade.

16. The cordless blind of claim 1 wherein the first rail is a headrail and the second rail is a bottomrail.

17. The cordless blind of claim 1 wherein the locking mechanism is comprised of a ratchet and the lock activator is comprised of a locking arm such that when the locking arm engages the ratchet, the lock mechanism is in the locked position to the unlocked position and lift cords can be removed from, but not collected on, the cord collector.

18. The cordless blind of claim 1 wherein the locking mechanism is comprised of a ratchet and the lock activator is comprised of a locking arm such that when the locking arm engages the ratchet, the lock mechanism is in the locked position and the lift cords can be collected, but not removed from, the cord collector.

19. A cordless blind comprising:

a. a headrail;

b. a bottomrail;

c. a window covering material connected between the headrail and the bottomrail;

d. a plurality of lift cords each attached to the headrail and passing into the bottomrail;

e. at least one cord collector about which at least one of the lift cords is wound;

f. a spring motor connected to the cord collector in a manner to maintain tension on the at least one cord collector such tension causing the plurality of lift cords to be collected on the at least one cord collector when the at least one cord collector and plurality of lift cords are free to move, thereby moving the bottomrail toward the headrail; and g. a lock mechanism attached to at least one of the cord collector and the plurality of lift cords, the lock mechanism having a locked position, each button remaining in it's respective position after being pressed wherein the plurality of lift cords are restrained from at least one of being collected on the cord collector and being removed from the cord collector, and an unlocked position that allows the cord collector and plurality of lift cords to move freely, the lock mechanism having a first button which, when pressed, will change the lock mechanism from the locked position and a second button which, when pressed, will change the lock mechanism from the unlocked position to the locked position.

20. The cordless blind of claim 1 also comprising an operator attached to the second rail, the operator sized and positioned to enable a user of the blind to pull the operator when the blind is fully raised and thereby lower the second rail.

* * * * *

UNITED STATES PATENT AND TRADEMARK OFFICE

CERTIFICATE OF CORRECTION

PATENT NO. : 7,117,919 B2
APPLICATION NO. : 10/704851
DATED : October 10, 2006
INVENTOR(S) : Ren Judkins It is certified that error appears in the above-identified patent and that said Letters Patent is hereby corrected as shown below:

Column 11, claim 19, lines 14 and 15, remove "each button remaining in it's respective position after being pressed" and insert in Column 12, line 9 after "position", --each button remaining in it's respective position after being pressed--.

Column 12, claim 19, line 6, after "position" insert --to the unlocked position--.

Signed and Sealed this

Twenty-first Day of October, 2008

JON W. DUDAS
*Director of the United States Patent and Trademark Office*